US005791298A

United States Patent [19]

Rodgers

[11] Patent Number: 5,791,298

[45] Date of Patent: Aug. 11, 1998

[54] WATER HEATER WITH LOW EMISSION GAS BURNER

[75] Inventor: Ian M. Rodgers, Chattanooga, Tenn.

[73] Assignee: Burner Systems International, Inc., Chattanooga, Tenn.

[21] Appl. No.: 743,881

[22] Filed: Nov. 6, 1996

Related U.S. Application Data

[60] Provisional application No. 60/006,279, Nov. 7, 1995.

[51] Int. Cl. [6] ..... F22B 5/00

[52] U.S. Cl. ..... 122/17; 126/361; 122/14

[58] Field of Search ..... 431/329; 126/361; 122/16, 17, 18, 14

[56] References Cited

U.S. PATENT DOCUMENTS

| | | | |
|---|---|---|---|
| 3,169,572 | 2/1965 | Constance et al. | 431/329 |
| 3,424,146 | 1/1969 | Patrick et al. | 431/329 |
| 3,857,670 | 12/1974 | Karlovetz et al. | 431/329 |
| 4,927,355 | 5/1990 | Haire et al. | 431/329 |
| 5,165,887 | 11/1992 | Ahmady | 431/329 |
| 5,240,411 | 8/1993 | Abalos | 431/329 |
| 5,355,841 | 10/1994 | Moore et al. | 126/361 |
| 5,511,516 | 4/1996 | Moore et al. | 122/17 |
| 5,520,536 | 5/1996 | Rodgers et al. | 431/329 |

*Primary Examiner*—Carroll B. Dority
*Attorney, Agent, or Firm*—Alan Ruderman

[57] ABSTRACT

An atmospheric, low emission gas burner within the combustion chamber of a hot water heater in which the combustion chamber is sealed against entry of air except for the air/gas mixture entering through the burner. The burner comprises a venturi through which gas and air enter and a diffuser disposed about the venturi, the diffuser and venturi constructed to take advantage of the high thermal buoyancy within the water heater. The burner operates at low manifold pressure and creates low emissions of NOx and CO. The burner diffuser has a multiplicity of small slots disposed on the upper surface which is covered by a course mesh fabric material having relatively large openings designed to keep the flame front above and off the diffuser while maintaining a stable flame that does not flashback. Several openings in the base of the combustion chamber permit escape of a pressure pulse that occurs upon initial ignition, a porous material or a flap covering each of the openings for permitting the pulse to escape but preventing air from entering therethrough.

5 Claims, 3 Drawing Sheets

WATER HEATER WITH LOW EMISSION GAS BURNER

REFERENCE TO RELATED APPLICATIONS

This application claims the benefit of U.S. Provisional application No. 60/006,279, filed Nov. 7, 1995.

BACKGROUND OF THE INVENTION

This invention relates to a gas burner and sealed combustion chamber of a heating appliance such as a hot water heater for providing a low NOx, low CO burner system having a high heat release and permitting manifold pressures which are relatively low, the system providing increased efficiency and having no exposed flame.

Gas water heaters, for example, typically comprise a cylindrical tank having a concentric inner cylinder of smaller diameter acting as a flue for the combustion products for transfer of heat from the products of combustion to the water which is disposed between the cylinders. This transfer of heat takes place throughout the length of the inner cylinder and at the top of the generally semi-spherical top of the combustion chamber. Most water heaters in the United States use burners which require secondary air and have high NOx (nitrite oxide and nitrogen dioxide) outputs. In attempts to reduce the output of NOx in these appliances prior art burners in the United States have been of the thermally active type, i.e., they comprise a large mass of metal that reduces the temperature of the flame as it heats up and acts as a heat sink from the flame. This reduction in flame temperature results in consequential reduction of NOx. One of the difficulties with these burners is that they only reduce NOx for a short period of time—while they are thermally active. Once these burners have become hot, the NOx levels are typically of a partially aerated burner, e.g. 50% primary air and 50% air disposed about the burner, and therefore the NOx levels are unacceptably high. It may be noted that the formation of NOx (both NO and $N0_2$) is undesirable since it contributes to acid rain and the formation of smog. California, for example, has imposed restrictions on the amount of NOx emissions from residential water heaters and other appliances.

Moreover, because of the requirement for secondary air in the burners used in water heaters of the prior art, there are air openings in the water heater which exposes the flame. This may have resulted in numerous cases of physical damage to human beings and property when flammable vapors have leaked to the vicinity of the water heater and ignited. When gasoline, flammable paint, paint thinners or the like are located in the same room or garage as the water heater, if these flammable materials should spill, ignition of the vapor and its source has been reported to occur on a number of occasions.

Other burners, such as that disclosed in PCT International Publication No. WO-92/01196, used primarily in boilers in Europe require higher manifold pressures in the order of approximately six to seven inches of water, and in the case of the burners illustrated in the aforesaid PCT application, 40 to 180 inches of water. In any event, prior art burners have not operated with manifold pressures as low as four inches of water as is typically available in the United States. The port loading, i.e., heat release per unit of area, is relatively low with prior art burners.

SUMMARY OF THE INVENTION

Consequently, it is a primary object of the present invention to provide a burner for use in a heater appliance, such as a hot water heater, that has a substantial reduction in the NOx emissions relative to that of the prior art.

It is another object of the present invention to provide a burner within the combustion chamber of a heater appliance which has a higher efficiency than the burner systems of the prior art.

It is a still further object of the present invention to provide a burner within the combustion chamber of a heater appliance such as a hot water heater, which substantially eliminates external flammable vapors from entering and igniting in the combustion chamber which could result in possible explosion.

Accordingly, the present invention provides a burner having a diffuser with a perforated deck section and a gas/air mixing/entrainment tube, the deck having porting configured in such a way as to keep the flame off the surface and thus relatively cool and the porting being covered with a course mesh fabric formed from high temperature resistant material to prevent flashback so that the flame front is on the surface of the mesh. In the preferred form, the porting is substantially rectangular in form with all the ports of the same configuration so that the ports are equal in area to promote a uniform flame height along the ported area substantially the entire length of the burner. The mesh has relatively large openings so as not to restrict the flow. All of the air required for complete combustion, with excess air, is pulled through the mixing/entrainment tube which acts as a venturi. The flame, therefore, tends to be substantially shorter than partially aerated burners since no secondary air is required to complete combustion. The shorter flame results in the deck tending to be hotter than partially aerated burners, but this tendency is overcome by the porting design and the uniform distribution over the burner surface.

The burner operates in conjunction with the combustion chamber of the appliance, e.g. the water heater. All the conventional secondary air openings in the appliance which are required with thermally active burners are closed off. The mixing tube of the burner is the only major opening for air to be pulled into the appliance. In this manner, the burner uses the thermal buoyancy of the appliance flue, i.e., the heated flue gases rise in the vertically extending flue. Sufficient amount of air is pulled through the burner to permit combustion to take place and provide an excess amount of air. This excess of pre-mixed combustion air reduces the maximum flame temperature and therefore the NOx level. The excess air and the thorough mixing in the mixing tube and burner body, results also in an extremely low CO (carbon monoxide) level. The short flame reduces the probability that the flame will be quenched by contacting the relatively cold surface of the water tank. Additionally a relatively high port loading, i.e., heat release per unit area, is attainable with the apparatus which contributes to keeping the diffuser relatively cool.

In view of the fact that the appliance is sealed to prevent secondary air openings, initial ignition and expansion of the gas/air mixture has a tendency to cause a positive pressure pulse to occur in the sealed combustion chamber thereby tending to set up vibrations resulting in a low frequency noise. The present invention overcomes this problem by locating several openings in the combustion chamber communicating with ambient surroundings which permits the expanded volume to escape and thereby reduce the amplitude of the pulse. These openings preferably are perforated and are covered either by respective flaps or porous material that allow the expanding pulse to escape but after the initial explosion and the pulling effect from the thermal buoyancy through the flue is established, substantially all the air is redirected through the burner.

Not only is there a substantial reduction of NOx by approximately ⅓ relative to prior art systems, but an unexpected increase in the appliance efficiency has been noted. Additionally, another advantage provided is that problems associated with flammable vapor leakages due to ignition of a vapor which has leaked from its container stored near a water heater in a confined area is precluded because the appliance is sealed since there is no need to have secondary air openings. Thus, there isn't any exposed flame to ignite these vapors.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
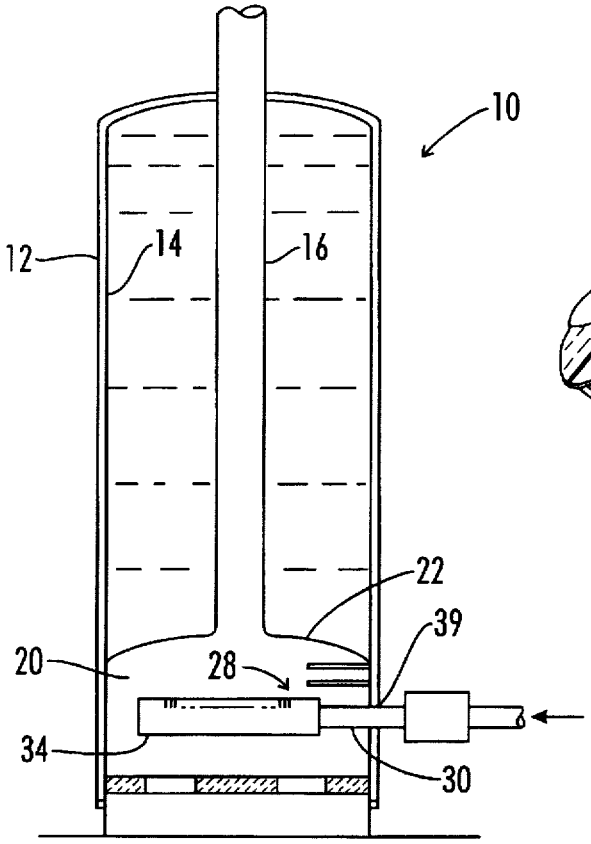
FIG. 1 is a cross sectional view in diagrammatic form through a hot water heater having a combustion chamber and burner constructed in accordance with the principles of the present invention.
Figure 2:
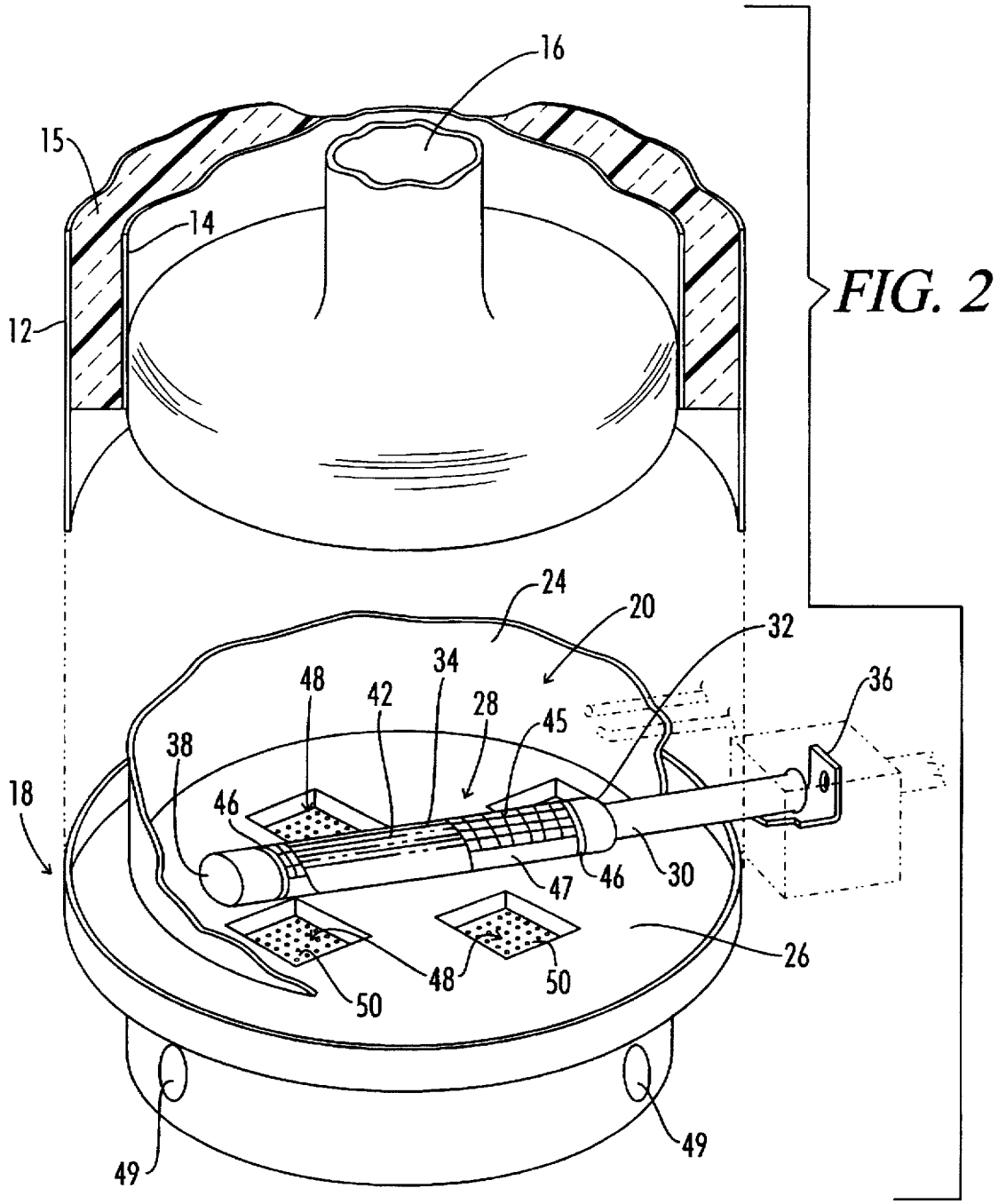
FIG. 2 is a fragmentary perspective view with portions thereof exploded away of the combustion chamber portion of the water heater illustrated in FIG. 1.

Referring to the drawings, and in particular FIGS. 1 and 2, there is illustrated a hot water heater 10 comprising an outer cylindrical jacket 12 spaced from an inner tank wall 14, there being thermal insulation 15 between the jacket 12 and the wall 14. Concentrically disposed within the tank defined by the wall 14 is a centrally disposed cylindrical flue 16. At the bottom of the water heater 10 is a base 18 within which is formed a combustion chamber 20. The upper wall or ceiling 22 of the combustion chamber 20 is of a semi-spherical configuration which opens at its central portion into the flue 16, the ceiling 22 being disposed at the top of a combustion chamber wall 24 which is positioned about a refractory floor 26. Water to be heated is disposed in the space between the tank 14 and the flue 16 above the ceiling 22 of the combustion chamber 20.

Disposed within the combustion chamber is a burner 28. The burner 28 comprises a gas/air mixing/entrainment venturi tube 30 partly disposed within the open end 32 of a diffuser 34, the remainder of the tube 30 extending out of the open end 32 of the diffuser and out of the combustion chamber and being attached to and spaced from a gas injection member 36 connected to a source of gas, such as natural gas outside of the water heater. There is a space between the injection member 36 and the end of the venturi tube 30 to permit air to be pulled through the venturi with the injected gas. The air and gas are mixed in the tube and flow into the diffuser 34 where further mixing occurs and where the mixture is burned. The end 38 of the diffuser remote from the end 32 is closed so that burning is confined within the burner diffuser.

Figure 4:
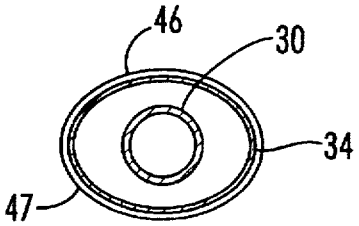
FIG. 4 is a cross sectional view taken substantially along line 4—4 of FIG. 3.
Figure 3:
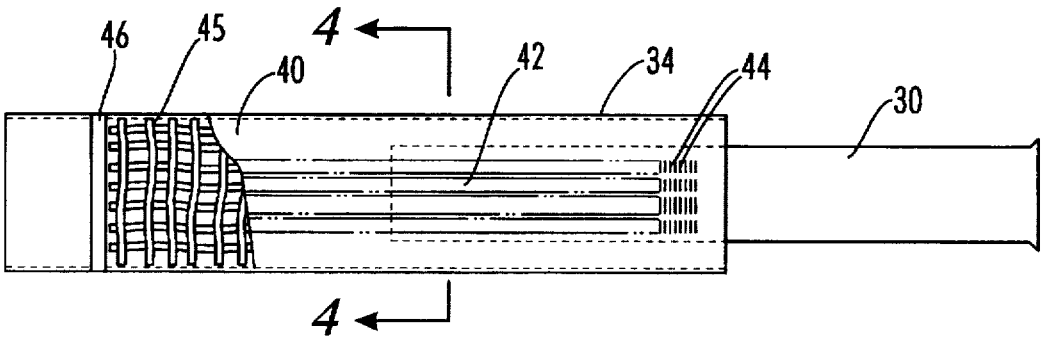
FIG. 3 is a top plan view of the burner of the present invention with portions thereof broken away.

The diffuser 34 effectively is a can and while the cross sectional configuration of the venturi tube 30 is circular, the diffuser preferably has a substantially oval cross sectional configuration as illustrated in FIG. 4. Preferably the minor axis of the oval configuration is in the vertical direction to minimize the height of the combustion chamber. The top of the burner diffuser has a deck 40 which may be substantially flat and in which there is porting 42. The porting comprises a multiplicity of small slots 44 which keep the flame front off the surface of the deck while maintaining a stable flame and maintaining the deck relatively cool. The slots 44 have a rectangular configuration with all of the ports being of the same form. These slots may be approximately 6 mm by 0.75 mm in a diffuser used in a hot water heater. Prior art burners of the venturi/diffuser type have utilized small circular ports in conjunction with slotted ports to keep the flame relatively close to the deck by increasing the stability, the circular ports offering increased resistance to the flow of gas and air so that less of the mixture flowed through these ports. This provided a lower velocity and high stability and thus made the deck burn hot.

In accordance with the present invention, the exterior surface of the tube 30 where it enters through the combustion chamber wall 24 is sealed, as at 39, as is the remainder of the combustion chamber between the wall 24 and the floor 26 of the water heater, and also between the floor 26 and the remainder of the base except as hereinafter described. Such an arrangement is also proposed in Joyce U.S. Pat. No. 5,317,992 Thus, the only air entering the combustion chamber is that which is drawn through the venturi 30, the venturi being sized so that approximately 30% more air than required for combustion is drawn in. This excess air reduces the maximum flame temperature and therefore the NOx level and additionally, the carbon monoxide level is also extremely low.

In the burner of the present invention, since all of the ports are equal in area, a uniform flame height along the entire burner length is promoted. Since, as aforesaid, there is an excess amount of air in the order of approximately 30% above that necessary to complete combustion, the flame tends to be shorter than partially aerated burners. This, however, is overcome by the porting configuration and good distribution over the burner surface without resulting in the deck being excessively hot. Additionally, the port loading may be relatively high due to the construction of the burner and the water heater.

Furthermore, in order to prevent flashback, i.e., the mixture within the diffuser 34 igniting and flashing back through the venturi 30, the deck 40 or at least the slots 44 are covered by a woven course mesh fabric 45 constructed from a material capable of withstanding temperatures of approximately 900° C. such as a ceramic fiber mesh or glass fiber mesh or the like. The mesh is course, having openings in the order of approximately 3 mm and the web, i.e., the material creating the openings, being approximately 1.5 mm thick. The large opening of the mesh does not restrict or resist the flow so that the pressure drop across the mesh is minimized. In fact, surprisingly and inexpicably it has been found that the pressure drop with the mesh on the top of the diffuser is less than without the mesh disposed thereon. Because of the negative pressure in the combustion chamber, the flame is readily stabilized on the large opening mesh material and does not propagate back to the stainless steel deck which is therefore maintained relatively cool.

The mesh fabric 45 may be held over the slots 44 by numerous means. For example, the fabric may be in the form of a cylindrical sock and pulled over the entire diffuser 34, or, as illustrated, it may be held on by bands 46 at the respective ends. If desired the bands 46 may be welded or the like to a sheet of metal 47 which is disposed between the bands and bent or wrapped about the diffuser except in the vicinity of the mesh fabric. In this manner the mesh will be tightly clamped against the diffuser. Moreover, if the mesh fabric is of a size substantially equal only to that of the diffuser top or deck, the longitudinally extending edges may be held against the diffuser by the sheet metal 47.

The burner of the present invention operates in conjunction with the appliance, i.e., the hot water heater, by blocking off all of the secondary air openings in the appliance, such secondary air openings being required with the prior art thermally active burners. The inlet to the venturi tube 30 of the burner is the only major opening for air to be pulled into the appliance. In this manner, the burner makes use of the thermal buoyancy, i.e., the rising of heat, of the appliance flue 16 resulting from its height. By operating in this manner, the excess air drawn through the burner for combustion results in a reduction in the maximum flame temperature and therefor a lowering of the NOx levels.

Figure 5:
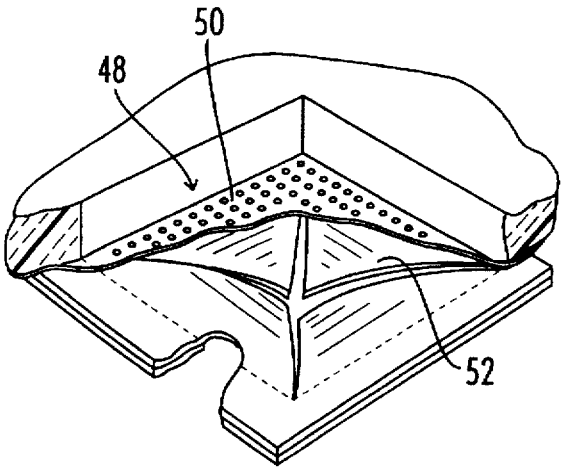
FIG. 5 is an enlarged perspective view of one of the combustion chamber relief openings and closure flaps.
Figure 6:
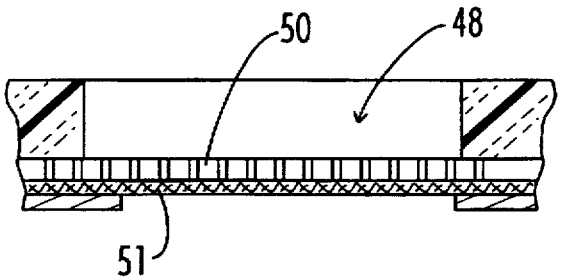
FIG. 6 is a cross sectional view through the combustion chamber illustrating an alternative pressure pulse relief opening closure.
Figure 8:
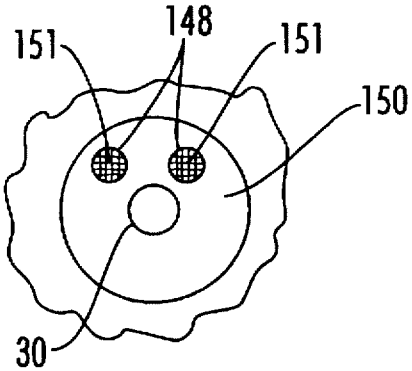
FIG. 8 is a view taken along line 8—8 of FIG. 7.

A problem encountered with this system initially was that initial ignition and expansion of the mixture caused a positive pressure pulse to occur in the combustion chamber since it is sealed. This pulse and the subsequent evacuation of the expanded gases tended to set up vibrations in the burner system which resulted in a low frequency noise. To overcome the problem, several openings 48, one or more, are formed in the refractory floor 26 of the base 18 and communicate with openings 49 opening externally of the base so as to allow the expanded volume to escape and therefore reduce the amplitude of the pulse. The openings 48 communicate with respective perforated plates 50 disposed therein with beneath which is disposed a respective porous sheet of fabric material 51 illustrated in FIG. 6 or a flap 52 illustrated in FIG. 5 formed from a material which withstands temperatures of approximately 200° C. to 300° C. such as ceramic fiber or glass fiber. The flap may comprise a planar member in which a pair of slits are formed intersecting at the center so that four triangular shaped members may be formed. These flaps allow the expanding pulse to escape as the triangular members are forced outwardly as illustrated in FIG. 5, but once the initial explosion is over and the pulling effect of the flue is established, the flaps are drawn closed against the perforated plates and all the air is redirected through the burner. If a porous fabric 51 is used it too may be drawn against the perforated plate to substantially seal the openings 48 after the initial explosion.

The burner volume of the burner of the present invention is substantially larger than that of prior art burners since the mixture of air is much larger because all the air for combustion, including the excess air, passes through the burner. This large burner volume helps achieve good distribution over the burner and reduces the pressure drop over the burners by keeping the velocity low throughout the burner body and mixing tube.

Figure 7:
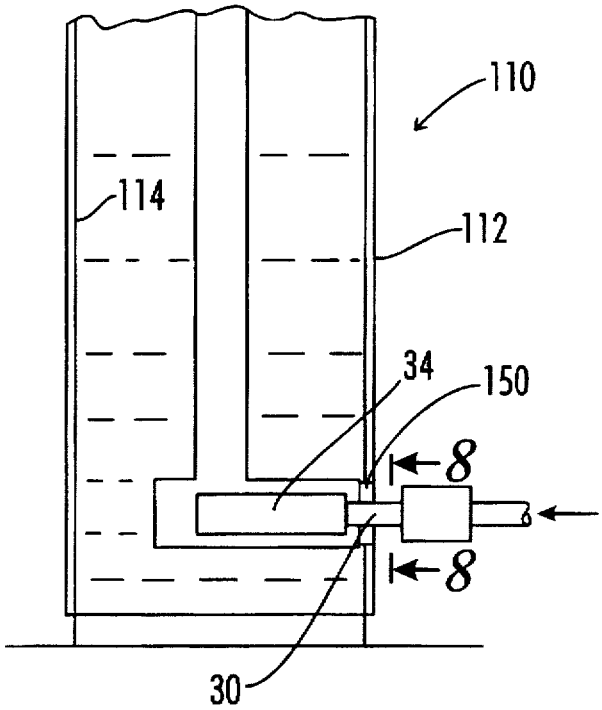
FIG. 7 is a view similar to FIG. 1 illustrating the burner of the present invention in a submerged heat exchanger water heater.

The invention may be applied to a water heater 110 having a submerged heat exchanger, i.e., the combustion chamber is substantially surrounded by water, as illustrated in FIG. 7. The diffuser 34 and venturi 30 may be the same as the water heater illustrated in FIG. 1, but the pressure pulse relief ports 148 are in a plate 150 in the walls 112, 114 of the water heater and communicates the combustion chamber with ambient surroundings. The ports may have the flap covering such as that illustrated in FIG. 5 or may have a porous fabric covering 151 similar to that illustrated in FIG. 6. In operation, the burner system is the same as that in the prior embodiment.

The use of the burner in a water heater combustion chamber in the manner described appears to overcome the problems heretofore referred to which are associated with flammable vapor leakages. In the present invention, all the secondary air openings are blocked and therefore there is no exposed flame. Any vapor leakage would enter the appliance through the mixing tube and merely be burnt as excess fuel. This is an unexpected safety feature of the burner and water heater of the present invention. Another unexpected result of the present invention is the increase in the efficiency of the appliance. Although the flue product temperature may increase slightly, the reduction in secondary air more than offsets this effect, and the result is an increase in appliance efficiency of approximately 1.5 to 2.5 percentage points. Thus, not only does the invention provide substantially reduced NOx emissions, but it also provides these additional advantages.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A water heater comprising a tank having a vertically extending substantially cylindrical water chamber, a combustion chamber disposed below at least a substantial portion of said water chamber, said combustion chamber having a heat transfer surface separating said water chamber from the interior of said combustion chamber, a flue communicating with said combustion chamber and extending vertically through said tank for venting said combustion chamber to ambient surroundings, a gas fired burner disposed in said combustion chamber, said burner comprising a horizontally elongated diffuser housing having an open end, a horizontally disposed elongated venturi tube having one end disposed within said diffuser and having another end extending out said diffuser for receiving flow of gaseous fuel from a source and for drawing ambient air therein with said fuel for mixing within said venturi to form a combustible mixture for burning within said diffuser, said diffuser having an upper surface including a multiplicity of ports, a course open mesh fabric disposed on said upper surface covering said ports, means for sealing said combustion chamber from said ambient surrounding such that only air drawn through said venturi enters said combustion chamber and said combustion chamber is under sub-atmospheric pressure, at least one pressure pulse alleviating opening communicating said combustion chamber with the ambient environment to permit an expanded volume of gas upon initial ignition of said mixture to escape to reduce the amplitude of the pressure associated therewith, and means for covering said openings to prevent air under ambient pressure from entering said combustion chamber.

2. A water heater as recited in claim 1, wherein said means for covering said openings comprises a flap which opens only when the pressure within said combustion chamber is substantially greater than ambient pressure.

3. A water heater as recited in claim 2, including a perforated plate disposed intermediate said flap and said combustion chamber.

4. A water heater as recited in claim 1, wherein said means for covering said openings comprises a porous material.

5. A water heater as recited in claim 4, including a perforated plate disposed intermediate said flap and said combustion chamber.

* * * * *